United States Patent [19]

Patterson

[11] 4,018,117

[45] Apr. 19, 1977

[54] CUTTING METHOD AND MACHINE EMPLOYING HEATED RECIPROCATING WIRE

[76] Inventor: Jan J. Patterson, 2450 Rollingview Drive, Smyrna, Ga. 30080

[22] Filed: Aug. 18, 1975

[21] Appl. No.: 605,732

[52] U.S. Cl. ..... 83/16; 83/171; 83/651.1; 83/661; 83/785; 83/793

[51] Int. Cl.[2] ..... B26F 3/12

[58] Field of Search ..... 83/16, 171, 661, 651.1, 83/793, 785

[56] References Cited

UNITED STATES PATENTS

| | | | |
|---|---|---|---|
| 14,413 | 3/1856 | Sharp | 83/785 |
| 139,644 | 6/1873 | Young | 83/793 X |
| 1,181,694 | 2/1916 | Sevenson | 83/793 X |
| 2,526,650 | 10/1950 | Gaibel | 83/171 |
| 2,789,199 | 4/1967 | Bjorksten | 83/171 |
| 2,972,669 | 2/1961 | Brown | 83/171 |
| 3,064,111 | 11/1962 | Newman | 83/171 X |
| 3,395,204 | 7/1968 | Olsson et al. | 83/433 X |

*Primary Examiner*—Frank T. Yost
*Attorney, Agent, or Firm*—Patrick F. Henry

[57] ABSTRACT

Combustible materials, including plastic sheets, plates, and blocks, also leather and all varieties of wood, may be cut along predetermined lines by engaging same with a heated reciprocating wire at temperatures which vaporizes the material rather than melting same. The machine providesa reciprocating wire which is heated by electrical resistance. A system of air quenching of the wire above and below the cutting zone is employed in order to attain incandescent temperatures at the point of cutting.

21 Claims, 17 Drawing Figures

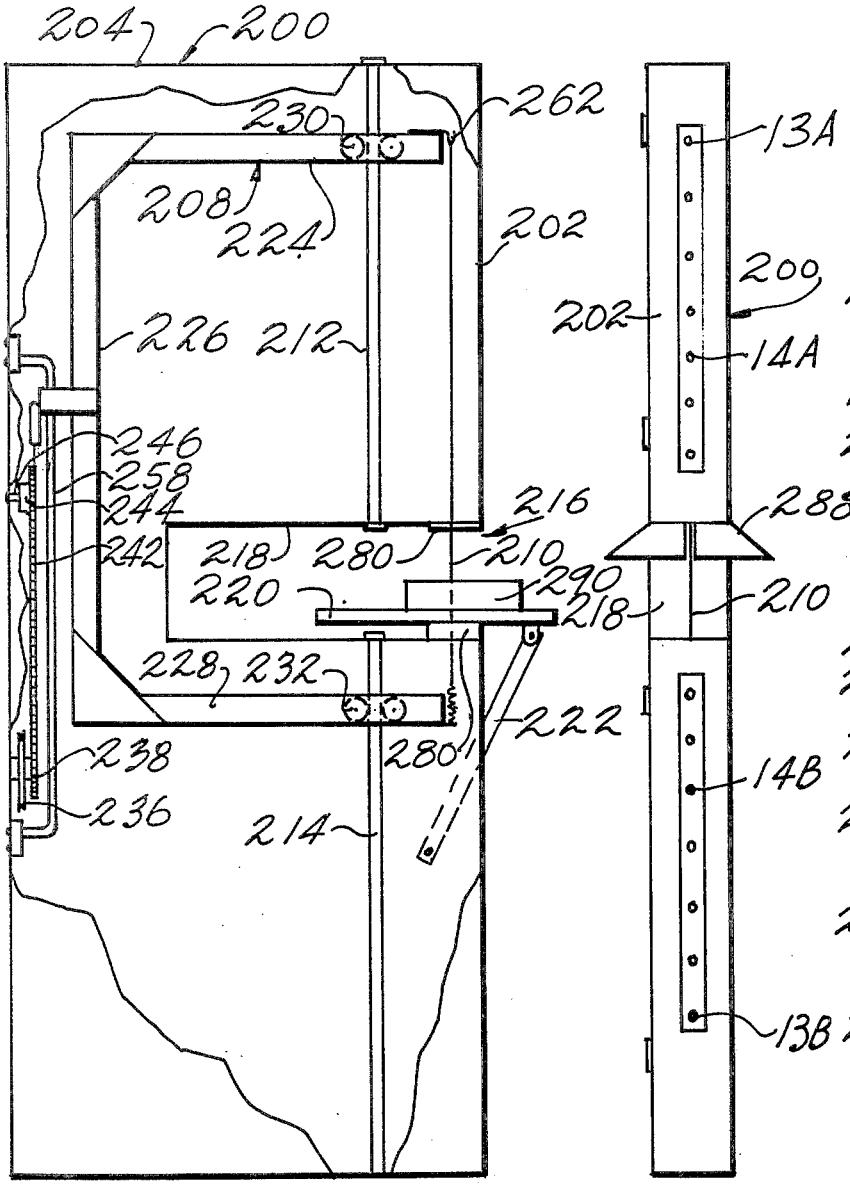
Fig. 10
Fig. 11
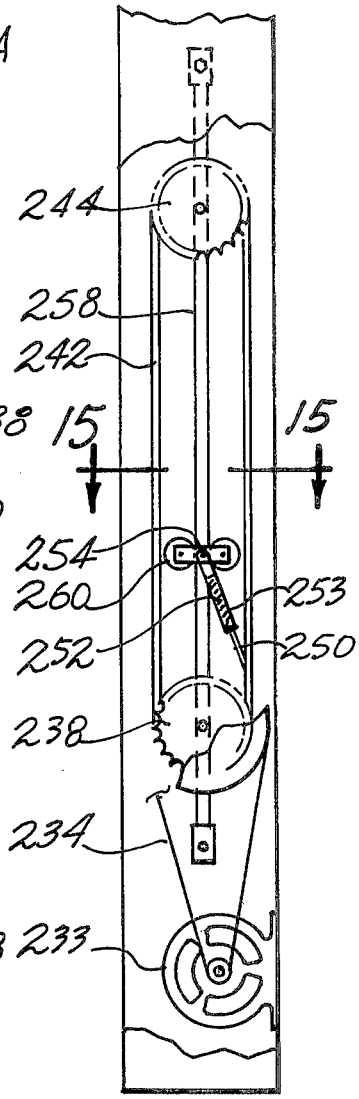
Fig. 12
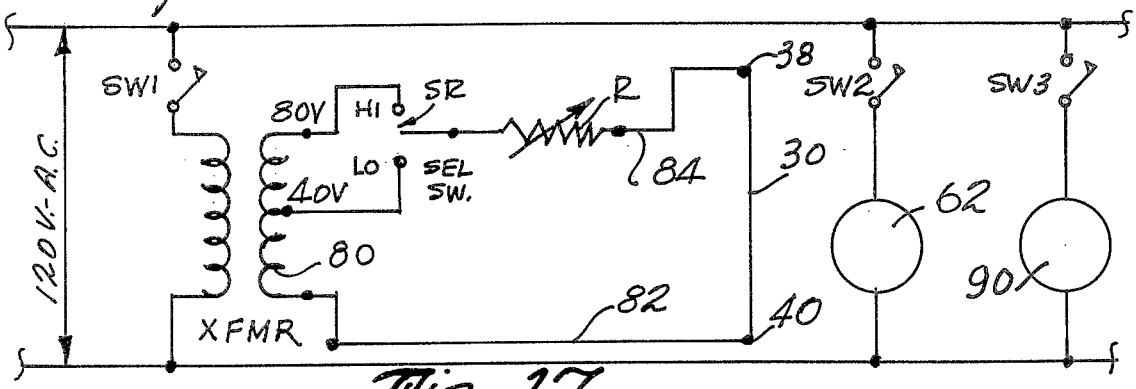
Fig. 17

CUTTING METHOD AND MACHINE EMPLOYING HEATED RECIPROCATING WIRE

BACKGROUND OF THE INVENTION

1. Field of the Invention

Electrical cutting machines employing electrically heated wires.

2. Description of the Prior Art

It is known in the prior art to cut sheet plastic and the like by means of electrically heated moving wires which melt the plastic. U.S. Pat. Nos. 2,526,650 and 2,972,669 disclose machines which employ continuous wire loops heated by means of the wire's resistance to an electric current supplied through rollers in contact with the cutting wire. It is difficult to join two ends of a fine wire, such as a Nichrome wire, without producing either a bulge or weak spot at the junction of the two ends. Therefore, it is difficult to produce an acceptable continuously moving heated wire loop of this sort. Furthermore, the method and apparatus disclosed for supplying electrical current to the endless wire loop would severely limit the temperature which could be provided at the cutting point of the wire to the extent that the cutting action would rely upon melting rather than vaporizing the material severed. Thus, the melted plastic tends to recycle into the cut and in effect weld the two sections together again. There are also machines such as that disclosed in U.S. Pat. No. 3,064,111 which employ a long length of fine wire fed in one direction from one spool to a motor driven take-up spool and heated by electrical resistance through two contacts bearing against the wire. After the cutting wire is completely unwound from the feeding spool, the direction of the movement is reversed. Such machines are impractical for cutting material several inches thick where high temperatures would be required as it is not practical to supply the cutting wire with sufficient amperage to sever dense materials because of the difficulty of providing positive electrical contacts with electrodes which slide against a moving wire.

Another machine for cutting sheets of plastic material is disclosed in U.S. Pat. No. 3,259,004 which is a sort of band saw without teeth, heated by friction against the plastic material, or possibly by heating the blade from an outside induction heater, but such machines are suitable for cutting only the most flimsy materials and not for performing fine, clean cuts on sheet plastic or other thicker, denser materials.

Likewise, there is a machine disclosed in U.S. Pat. No. 3,585,889 which cuts plastic material by means of a reciprocating wire but which is heated by the friction generated by the movement of the wire across the surface of the material being cut. It is impractical to generate enough heat by friction for the cutting of various types of sheet plastic material. Also, it would appear that the heat of friction in such a machine would, at most, barely melt the material.

SUMMARY OF THE INVENTION

The present invention provides a viable reciprocating hot wire cutting device capable of severing hard, high density materials such as acrylic plastics, and a variety of hard and soft woods through the use of a fine gauge cutting wire, such as Nichrome 5, or equal, capable of withstanding the incandescent temperatures required for vaporizing the materials rather than melting same.

An object of this invention is to provide a method and machine, mentioned in the preceding paragraph, employing a means to move the wire in a pattern in which it retraces its path and to guide the wire in such a manner that it does not deviate from this path.

Another object of this invention resides in the provision for the use of an air quenching means for cooling the cutting wire. This provision for air quenching is located above and below the cutting zone, while that section of the cutting wire which is exposed in the cutting zone is permitting to attain tempratures which cause it to become incandescent.

Other objects and advantages will appear from the description and drawings.

BRIEF DESCRIPTION OF THE DRAWINGS

FIg. 10 is a side elevation view of the machine shown in FIG. 8, with parts omitted, illustrating movement of the traveling wire frame.

FIG. 11 is a front elevation view of the machine in FIG. 8.

FIG. 12 is a cross-sectional view of the machine taken along line 12—12 in FIG. 8.

FIG. 4 is a side elevation view of the detail shown in FIG. 13.

FIG. 16 is an enlarged view of a wire attachment detail.

FIG. 17 is a schematic wiring diagram of the circuit in the machine in FIG. 1.

DESCRIPTION OF THE PREFERRED EMBODIMENTS

Figure 1:
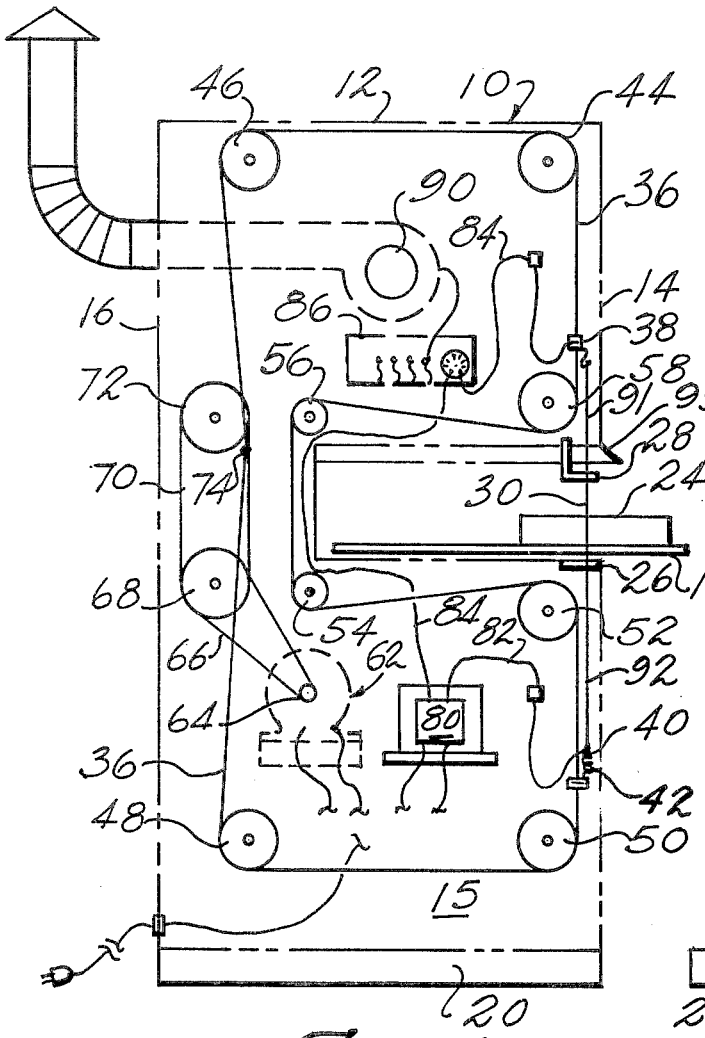
FIG. 1 is a side elevation view of the first embodiment of the invention with the side removed.
Figure 2:
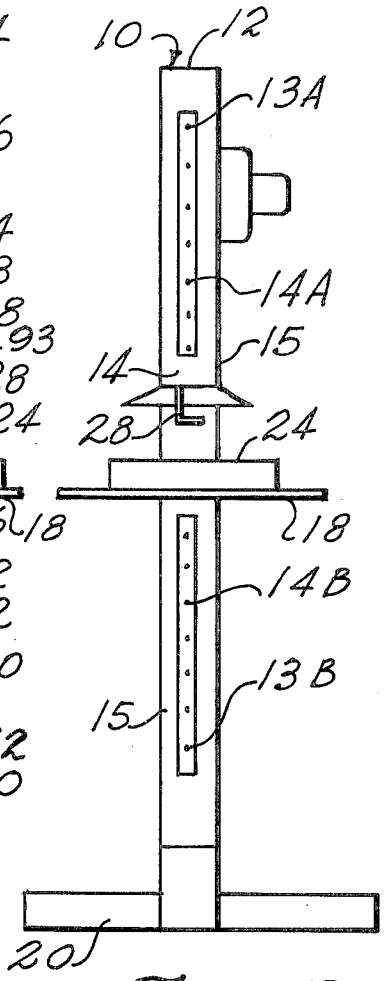
FIG. 2 is a front elevation view of the machine shown in FIG. 1.

The machine which is designated generally by reference numeral 10, comprises a machine cabinet employing a suitable vertical and horizontal framework covered by a metal housing comprising a top 12, front 14, sides 15, back 16 and work table 18, supported on a bottom machine base 20. The work table, or saw platform, 18 is supported on the machine framework to provide a horizontal support surface on which is supported a plastic material 22, such as a block or sheet of acrylic plastic, to be cut. A stationary wire guide assembly 26 located below the work table 18 employs a wire guide means. An adjustable wire guide assembly 28 is located on the machine 10 frame above the work table 18.

The resistance wire cutting element designated generally by reference numeral 30 is guided between the fixed or stationary wire guide assembly 26 and the adjustable wire guide assembly 28 to provide a reciprocating wire 30 above and through a hole in the work table 18, for the purpose of cutting plastic (or wood) material 22 placed thereon and manipulated by hand. Wire 30 may be Nichrome wire such as a Driver-Harris No. V, or equal, capable of withstanding incandescent temperatures required for vaporizing materials rather than melting same. Wire 30 is reciprocated and caused to retrace its path in such a manner that positive electrical contact is maintained and the wire is not bent or worked in the process. The guide means, the fixed guide 26 and adjustable guide 28 each have two pivotally connected bearing sections 31, 31' having bearing surfaces molded from a material comprised of gypsum plaster (hydrated calcium sulfate) and "Teflon" (TM): (trademark for Tetra Fluoro Ethylene) particles. Adjustable guide 28 has pivoted jaws 32 each holding a bearing 31, 31' on a base plate 33. Both guides 26, 28 have adjustable springs 34 and adjustment nuts 35. The bearing sections 31, 31' are shaped so that they may be held in a frame so as to provide a tongue and groove conformation. The cutting wire 30 rides between sections 31, 31' in such a manner that the opposing springs 34 exert a slight pressure on the cutting wire to hold it in a true path.

Wire 30 is reciprocated by means of a nonconducting drive cable 36 having the strand of Nichrome 5 wire 30 attached thereto by a thermal clip 38 attached at one end and by means of another clip assembly 40 at the other end. which passes around a series of idler pulleys 44, 46, 48, 50, 52, 54, 56 and 58 located on respective shafts at different locations on the frame of the machine. It will be noted that the path of this nonconducting drive cable 36 forms an open throat between pulleys 58 and 52. The work table 18 is mounted on the machine frame parallel to base 20, at the lower extremity of this throat. The strand of Nichrome 5 cutting wire passes through a ½ inch round hole in the work table 18. One end of wire 30 is attached by means of the terminal clip assembly 38, to the nonconducting drive cable 36 at a point just above pulley 58 by hooking a knotted end of wire 30 in a clip 59. Clip assembly 40 is attached to one end of a take-up spring 42. The other end of this spring 42 is connected to the nonconducting drive cable 36 at a point below pulley 52. In this way the Nichrome 5 cutting wire 30 is suspended in such a manner that it closes the throat formed by the path of the nonconducting drive cable between pulleys 58 and 52.

The motor 62 has a drive pulley 64 driving a belt 66 which drives a double grooved pulley 68. A belt 70 riding in the second groove of pulley 68 drives idler pulley 72. A swivel device 74 is attached to belt 70 and firmly connected to nonconducting drive cable 36. When the motor 62 is operated, belt 70 revolves around pulley 68 and 72 in an elliptical pattern. This action causes the nonconducting drive cable 36 to first move upward for the travel distance between the outer circumferences of pulleys 68 and 72, then to reverse itself and move downward the same distance and again reverse its movement. This reversing action is translated to the cutting wire 30 by the nonconducting drive cable to provide a reciprocating motion.

Electrical current for providing electrical resistance heating is supplied through a transformer 80 to the cutting wire through flexible leads 82 and 84, which are firmly attached to the thermal clip assemblies 38 and 40, respectively. Also included in the electrical circuit with transformer 80 are a control panel 86 which includes a rheostat R and switches SR for adjusting the voltage and resistance in the Nichrome wire circuit. The control panel 86 also includes a separate switch SW2 for the drive motor and another switch SW3 for the motor of an exhaust fan 90.

Except for the throat of the "C" where the worktable 18 is provided, the entire machine is mounted in a cabinet completely enclosed and made as airtight as possible, except for vent holes 14A and 14B in the front panel of the cabinet in the area where the Nichrome wire 30 travels. The exhaust blower 90 is mounted in the cabinet to serve two purposes: one is to remove the fumes which occur directly above the work table when the materials being cut are vaporized in the cutting process. This is accomplished by means of an exhaust vent 93 immediately above the work table 18. The other purpose is to provide air movement for quenching or cooling those sections of the cutting wire 30 not in contact or not imminently to be in contact with the material being severed. This air quenching action has been found to be basically worthwhile to the efficient performance of this machine. Experimentation in cutting a wide variety of materials has shown that the best results, such as fast cutting and smooth, polished appearing cut surfaces are only achieved when the cutting wire glows brightly and reaches a temperature in the range of 1500° F to 1700° F. Maintaining this temperature in the cutting wire 30 where it is in contact with the material being severed 22, without air quenching, those portions of the cutting wire 30, not in contact with the work, could result in overheating the wire above 91 and below 92 the work area, so that the wire would soon disintegrate, depending upon the particular wire.

When the material being cut 22, comes in contact with the cutting wire 30, the material acts as a heat sink, cooling the wire. This means that these sections of the wire 91 and 92 not being cooled by contact with the material would overheat.

When a heavy cutting wire is employed, lower voltage or higher resistance is required to reach the optimum temperature for satisfactory cutting action. This may be achieved by means of the rheostat and switches on the control panel 86 but to compensate for the larger cross section or greater mass of the larger wire, it is desirable to provide more air movement around the wire in areas 91 and 92. This adjustment may be made by changing the position of the louvres which pivot at points 13A and 13B to open or close air vents 14A and 14B.

The wire guide 28 and a similar wire guide 26 mounted below the work table 18 provides accurate guiding of the Nichrome wire 30. The upper guide 28 is mounted in such a way that it may be raised up or down by means of a slide and set screw 96 according to the thickness of the material being severed.

Figure 6:
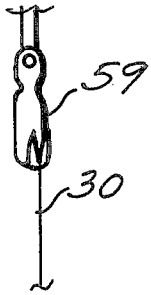
FIG. 6 is a side elevation view of another, second embodiment with the side removed.
Figure 6:
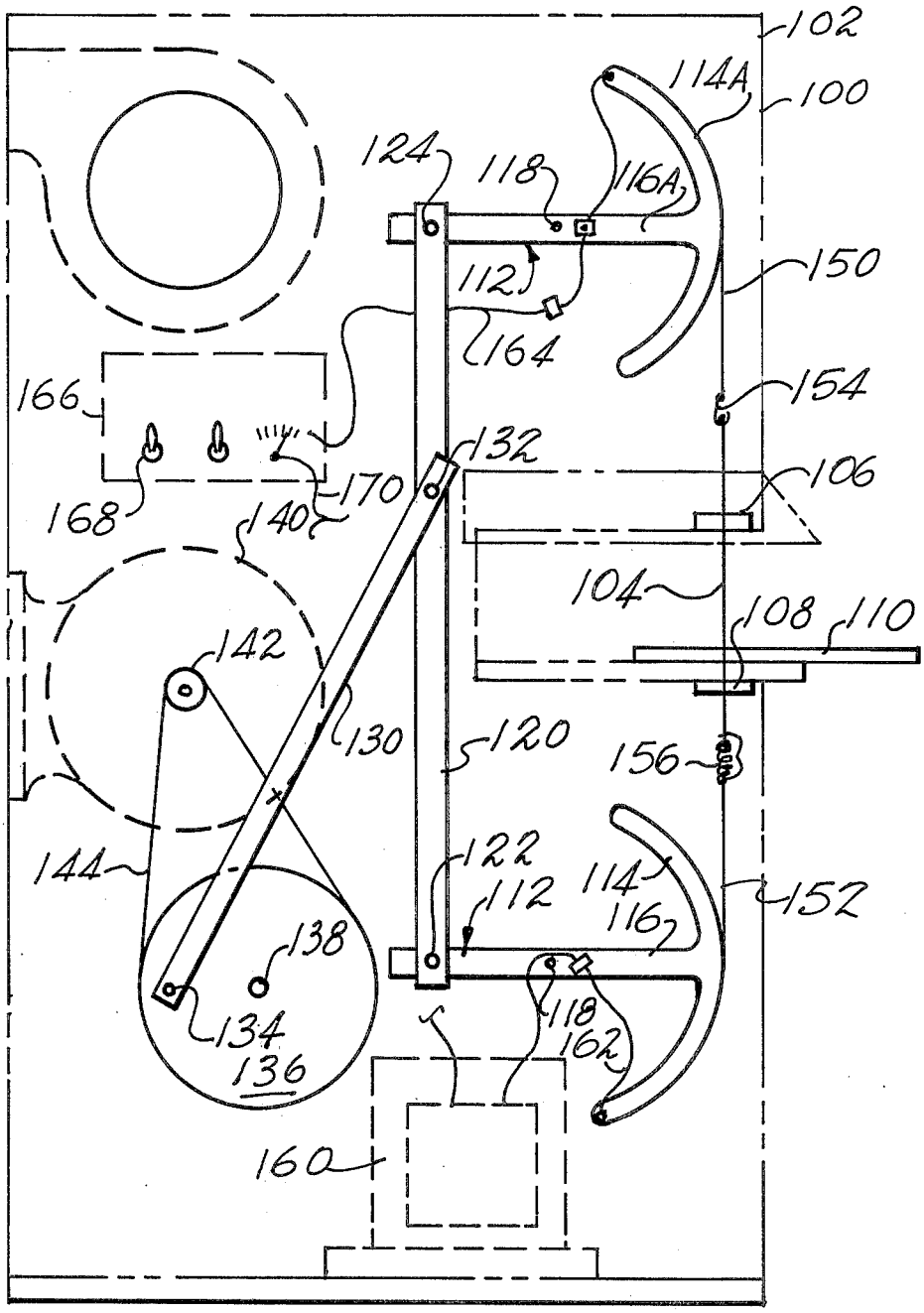
Figures 8, 9, 13, 14, 15:
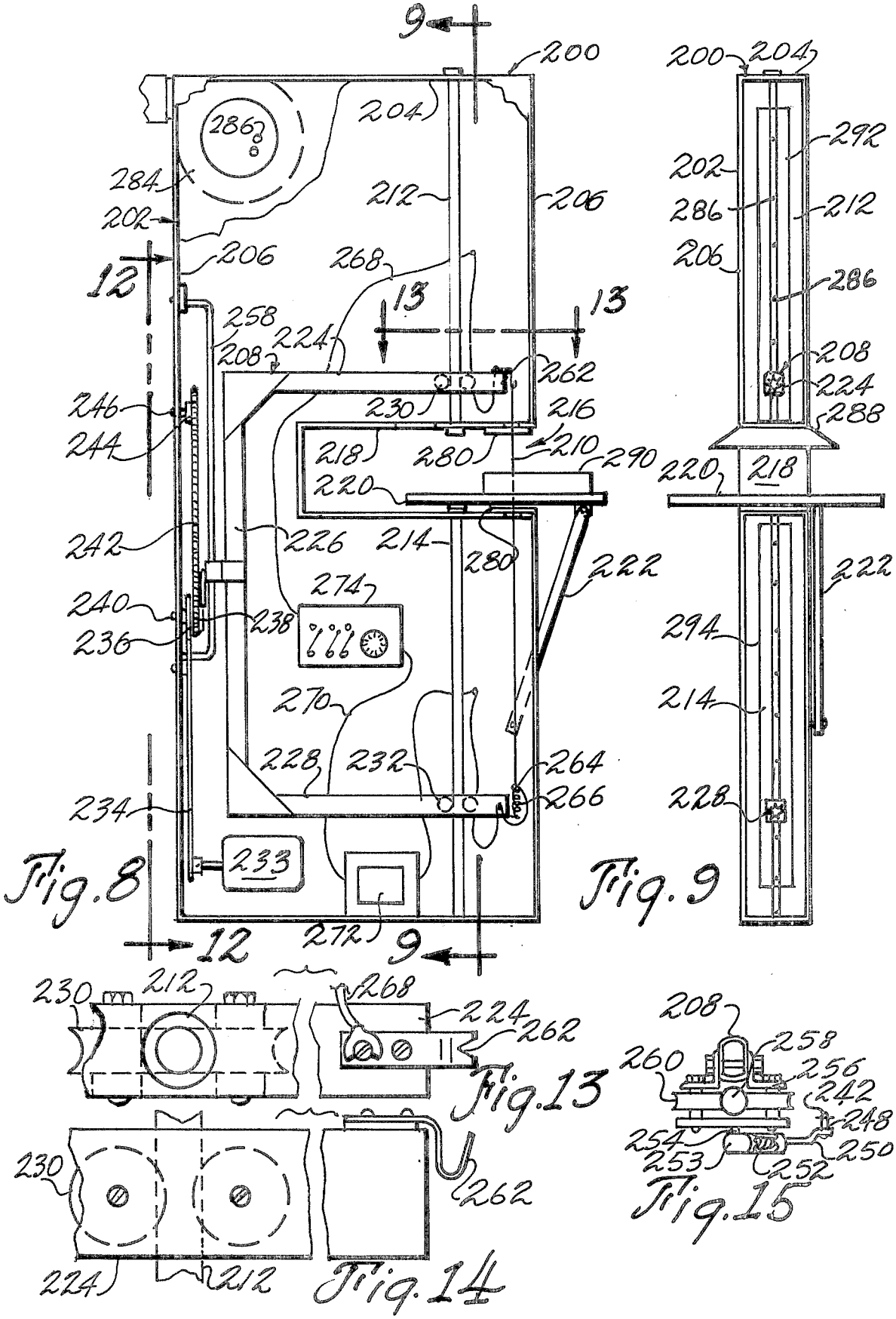
FIG. 8 is a side elevation of another, third embodiment of the cutting machine with the side of the cabinet removed.
FIG. 9 is a cross-sectional view taken along lines 9—9 in FIG. 8.
FIG. 13 is a cross-sectional view taken along lines 13—13 in FIG. 8.
FIG. 15 is a cross-sectional view taken along lines 15—15 in FIG. 12.

In the modified form shown in FIG. 6, a machine cabinet 100 employs a machine frame 102 on which is mounted a reciprocating Nichrome cutting wire 104 operating through suitable guide means 106, 108 mounted above and below a work table 110 which is located in the throat of a cabinet shaped like a letter C. A pair of rocker assemblies 112 comprise a circular rocker member 114, 114A and an elongated rocker shaft 116, 116A mounted on a pivot 118 on the frame of the machine. The ends of the respective rocker arms 116 and 116A are connected by means of a rod 120 attached to respective pivots 122, 124 and serve to oscillate the respective rocker arms 114 and 114A. In turn, rod 120 is driven by connecting rod 130 having one end attached to a pivot 132 on the rod 120 and the other end attached to a drive pulley pivot 134 on a drive wheel 136 rotating about a shaft 138 mounted on the machine. A motor 140 has a drive pulley 142 which drives the drive wheel 136 by means of a drive belt 144.

The Nichrome wire 104 is attached to the respective rocker arms by means of flexible wire conductors 150, 152 attached by tie clips 154 and a take-up spring 156. The respective flexible conductors are electrically connected through a transformer 160 by means of electrical flexible conductors 162, 164 and conductor 164 leads through a control panel 166 having switches 168 and a controllable rheostat 170 for controlling current to the Nichrome wire 104.

Referring to the third embodiment shown in FIGS. 8–15 inclusive, the machine 200, which is similar to those in the previous embodiments, has a machine frame 202 comprising horizontal frame members 204 and vertical frame members 206. A traveling C-frame 208 provides a means for moving the heated wire 210 in lieu of the apparatus provided in the previous embodiments. The frame 208 is mounted for vertical movement on a pair of vertical guide bars 212, 214 which are in substantial alignment but separated by the work space 216 which is defined by structural members 218 to provide a structural support for a work table 220 supported on a hinged strut 222.

The traveling C frame 208 comprises an upper horizontal frame member 224 attached to a rear vertical frame member 226 which is attached to a lower horizontal frame member 228 thereby providing a rigid frame. A pair of rollers 230 on frame 208 are mounted about upper guide bar 212 and a pair of rollers 232 are mounted on frame 208 about lower guide bar 214 so that frame 208 travels freely upwardly and downwardly on guide bars 212, 214.

The frame 208 is driven and reciprocated vertically by means of a frame drive assembly comprising a motor 233 which drives a belt 234 driving a pulley 236 which has the face thereof attached to the face of a sprocket 238 on common shaft 240. Sprocket 238 drives a drive chain 242 which drives around another sprocket 244 mounted on a shaft 246. The drive chain 242 is attached to the C-frame by means of a pivot connector assembly comprising a pivot pin 248 attached to one link of the chain and also attached to a spring cartridge which comprises a plunger 250 and a double acting spring 252 inside a case 253 (see FIGS. 12 and 15). A connector pin 254 attaches one end of the plunger 250 to a bracket 256 attached about a vertical guide bar 258 to the traveling C-frame 208, supporting a pair of rollers 260 which travel on bar 258.

The cutting wire 210 is attached to the C-frame by means of a clip assembly 262 which is insulated from the frame 208 and the wire 210 passes through a hole in the work table 220 and is attached at the bottom end of the frame 208 by means of a similar clip assembly 264 suspended on a take-up spring 266. Flexible electrical leads 268, 270 are attached to each clip assembly and through a transformer 272, control panel 274 to power source such as 115 volts A.C. The wire guide means may be the spring biased, jaw arrangement with gypsum bearings, etc. as described previously.

When motor 233 is energized, chain 242 is caused to travel in an elliptical path pulling pivot connector 250 to the upper perimeter of sprocket 244 and then down to the lower perimeter of sprocket 238. This action moves C frme 208 up and down the distance between the outer perimeters of sprockets 244, 238 which causes C frame 208 and cutting wire 210 to move up and down the same distance. Wire guides 280, one mounted on the cabinet just above the work table 220 and another under work table 220 hold the cutting wire 210 in an axially stable path. When a switch is turned on in control panel 274, the cutting wire 210 which is Nichrome V, resistance wire, is energized and heated. Another switch (not shown) in control panel 274 energizes an exhaust blower 284 which draws air through vent holes 286 and also through venthood 288. This suction action draws air from outside the cabinet across the cutting wire 210 both above and below the work area of the machine, serving to cool the cutting wire 210 in these areas where it is not in contact with the material 290 being cut. Sliding louvres 292, 294 may be adjusted to increase or decrease air flow as needed to maintain optimum cutting temprature in the work area without overheating the wire above and below this area. As this machine employs only a relatively short strand of Nichrome 5 cutting wire, little resistance is encountered and high temperatures (1500° F to 1700° F) can be attained in the cutting wire with low voltage and amperage. However, it is desirable to provide vent cooling louvres 292, 294 in order to air quench those portions of the wire not in contact or not imminently to be in contact, with the material being severed. By air quenching the sections of wire inside the cabinet above and below the work area it is possible to raise the wire temperature in the work area to optimum temperature without overheating those sections not in contact with the material being severed.

In this manner the optimum temperatures for cutting materials of various densities and thicknesses may be attained without damaging the cutting wire through overheating. At high wire temperatures, 1500° F to 1700° F, combustible materials are vaporized, rather than melted and the vapors or fumes are removed through venthood 288.

Figure 3:
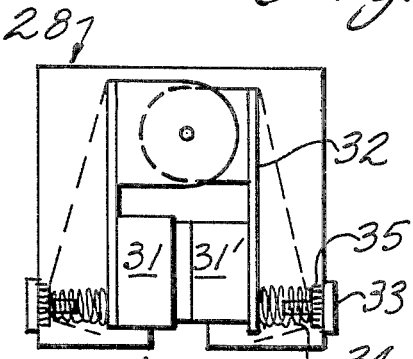
FIG. 3 is an enlarged top plan view of the wire guide.
Figure 5:
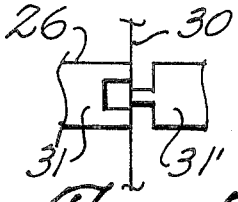
FIG. 5 is a side elevation view of the wire guide bearings.
Figure 4:
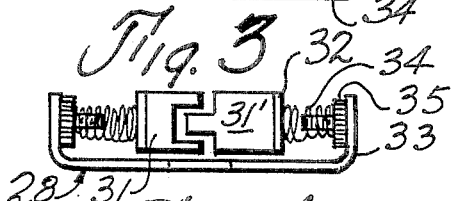
FIG. 4 is an end view of the wire guide shown in FIG. 3.
Figure 7:
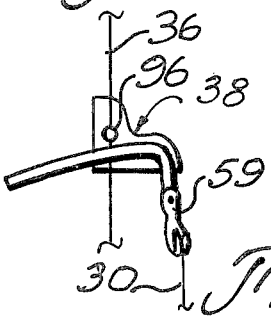
FIG. 7 is an enlarged side elevation view of a wire attachment detail.

In order to hold the cutting wire in an axially stable position when material to be cut is fed into the wire, the wire guide system (guides 106 and 108 in FIG. 6; guides 280 in FIG. 8; guides 28 in FIG. 1) is provided so that the cutting wire does not deviate from its true path when pressure is placed against it. In the manner described in connection with FIGS. 3 et al, each guide consists of a bracket and two sections of a special material made of plaster and Teflon. This material is molded so that one section forms a tongue and the other forms a groove. These are mounted in a pivoted bracket and each section is backed up by lower compression spring in such a manner that the tongue and groove oppose each other. The cutting wire is passed between this tongue and groove at a 90° angle so that the wire moves freely up and down and soon wears a notch in the plaster material, which serves as a track to hold the cutting wire in an axially stable position.

Therefore, it is seen that the present invention makes it possible to use a comparatively short strand of Nichrome V, or similar wire 30 et al, and to eliminate such bothersome things as changing spools of wire.

Also the use of welded junctions and all of the attendant problems has been eliminated. It is not necessary to provide electrical commutators or sliding electrical contacts because the present wires may be solidly connected directly to the cutting wire 30, 104. The use of rollers or sliding electrodes in contact with the cutting element has been eliminated and in the present device the two ends of the cutting wire are clamped in fixed position with respect to their electrical connection, and flexible electrical leads are permanently attached to the clamps. Such an arrangement reduces the possibility of poor contact and arcing, and completely avoids the abrasive effects on the cutting wire which rollers or sliding contacts woud cause. Since it may be necessary to replace the heated wire in any system, in the present device such changes are made quite easily, quickly and at very small cost for the wire, as compared to continuous systems in which changes in the wire are very time consuming and the wire is very costly. It is also possible to change wires and wire sizes with very little difficulty in a range as fine as 0.005 and as large as 0.025 for various cutting operations.

This method for precisely fixing the vertical path in which the cutting wire travels makes it practical for this device to precisely duplicate a design by use of a pantograph.

Various material may be cut, including polyethylene, polystyrene, (solid or expanded), polyurethane (foam, rigid or flexible), acrylic (methyl-methacrylite), nylon, polyvinyl acetate, and polycarbonate, walnut, mahogany, hickory, oak and plywoods.

Other wires may be used than Nichrome in all sizes from about 0.005 to 0.025 - fine wires requiring less amperage and making finer cuts and the heavier wires being better for thicker or denser materials. An example of approximate cutting speeds: ⅛ acrylic at 10 inches per minute; ¼inch basswood at 20 inches per minute; ¼ walnut at 4 inches per minute. A typical machine makes one complete cycle per second and the wire travels about 2'6" in each direction which is about 5 feet per second.

With the present device, the strand of cutting wire 30 may be easily detached from the clamp at one end and threaded through a small hole drilled in the material, then reattached to the clamp so that a continuous design, such as a ring, may be cut out of the material without a break in the outside border.

The foregoing description does not constitute any sort of limitation on the scope of the invention since various changes and departures may be made without avoiding the invention as defined only by a proper interpretation of the appended claims.

What is claimed:

1. In a cutting device: an elongated cutting wire, support means for elongating and supporting said cutting wire at spaced locations for reciprocating to be engaged by a material (including sheet plastic and the like) for the cutting thereof, drive means for driving said support means to reciprocate said wire substantially to retrace the path of the wire in one direction of substantial longitudinal movement and thence in the opposite direction, and electrical means connected to said wire for supplying electrical current to cause said wire to become heated to maintain a cutting temperature in excess of 1,000° F. while in motion.

2. The device claimed in claim 1 wherein said wire is connected with a continuous, endless drive member and said endless drive member is driven by a reciprocating drive means.

3. The device claimed in claim 2 wherein said reciprocating drive means comprises an electrical motor, a first pulley and a second pulley, a drive belt between said first and second pulleys, and a swivel means attaching said drive belt to said endless cable to cause reciprocating motion thereof.

4. The device claimed in claim 1 wherein there is an upper wire guide means and a lower guide means through which said heated wire is caused to travel in reciprocating motion.

5. The device in claim 1 wherein: said cutting wire is elongated by means of an attachment at each end of said wire, and a means for tensioning said wire in elongated condition.

6. The device claimed in claim 4, wherein said wire guide comprises a wire guide material composed of a mixture of gypsum plaster (hydrated calcium sulfate) and tetra-fluro-ethylene.

7. The device claimed in claim 1 wherein there is a cooling means both above and below the cutting zone of said reciprocating wire to cool same by air so that the extremities of the length of wire are held to a lower or equal temperature to that of the middle portion of the wire where the cutting action takes place.

8. The device in claim 1 wherein said means for reciprocating said wire comprises a first and a second oscillating member having said wire extended therebetween for simultaneous movement of said oscillating members to move said wire, and means for causing said oscillating members to oscillate.

9. The device in claim 8 wherein said oscillating members each comprises a rocker assembly and a rocker shaft therefor.

10. The device in claim 9 wherein said rocker assemblies each comprises a circular rocker member and said rocker shaft is an elongated member attached to said respective rocker members and a connecting rod for driving said rocker members.

11. The device in claim 10 wherein said connecting member is driven by a drive wheel, and means for driving said drive wheel.

12. The device claimed in claim 1 wherein said means for reciprocating said wire comprises a means for holding said wire in elongated position, and a means for moving said means for holding said wire to reciprocate same.

13. The device in claim 1 wherein there is a movable frame mounted on said device, means for mounting said wire in elongated position on said movable frame, guide means for said frame, and power means for reciprocating said frame on said guide means.

14. The device in claim 13 wherein said power means comprises a motor, an endless member driven by said motor, and means connecting said endless member to said frame for reciprocating said as said endless member moves.

15. The device in claim 14 wherein said endless member is a chain, and said means connecting said endless member is a pivoted member having spring means thereon.

16. The device claimed in claim 15 there is a second guide means on said frame, and roller means on said guide member for moving thereon while supporting said frame, and means for attaching said endless member to sid roller means.

17. The device in claim 15 wherein said movable frame is substantially C-shaped providing a space in which said wire is mounted, a pivoted member attached to said chain, a bracket having rollers thereon, a guide member on said frame on which said rollers are mounted, sprin means connecting sid pivoted member to said bracket member to reciprocate said frame as said endless member moves.

18. In an apparatus for cutting solid sheet plastic material and the like: a machine frame, means on said frame defining a space in which is mounted a reciprocating cutting wire and in which may be inserted the sheet plastic and the like to be cut, a cutting wire mounting for reciprocating movement on said frame, an endless drive member having one end connected to the other end of the cutting wire whereby reciprocation of said drive member reciprocates said cutting wire, upper guide means and lower guide means through which said cutting wire is guided during reciprocation thereof, and said upper and lower guide means being mounted adjacent the opening, a plurality of pulleys having said drive cable engaged thereabout for directing said drive cable in an endless manner on said machine frame, a first pulley and a second drive pulley, an endless belt mounted on said first and second drive pulleys, an electrical drive motor and means for driving said first drive pulley from said electrical motor, a first electrical conducting member attached to one side of said endless member, a second electrical conducting member attached to the other side of said reciprocating cutting wire, a source of electrical energy having said first and second electrical cables connected thereto, control means for controlling the current supply to said first and second conductor means.

19. The device in claim 18: an air blower on said machine and an exhaust conduit for said blower, said blower having an outlet thereon within said machine frame for circulating air to cool said wire above and below the heated cutting area by drawing air through louvred vent holes on the face of said machine frame.

20. In a method of cutting combustible material such as sheet plastic or wood boards and the like, the steps of:

reciprocating a wire, electrically heating said wire to maintain a cutting temperature in excess of 1,000° at which said plastic, wood or other material in the path of said wire is caused to vaporize rather than melt whereby the material being cut does not melt and collect in the cut.

21. The method in claim 20, reciprocating said wire so as substantially to retrace its path of movement in one direction and then in the other direction.

* * * * *